US005391981A

United States Patent [19]

Masson

[11] Patent Number: 5,391,981

[45] Date of Patent: Feb. 21, 1995

[54] CURRENT SOURCE ADAPTED TO ALLOW FOR RAPID OUTPUT VOLTAGE FLUCTUATIONS

[75] Inventor: Gilles Masson, Grenoble, France

[73] Assignee: Thomson Composants Militaires et Spatiaux, Courbevoie, France

[21] Appl. No.: 897,819

[22] Filed: Jun. 12, 1992

[30] Foreign Application Priority Data

Jun. 14, 1991 [FR] France ..... 91 07320

[51] Int. Cl.[6] ..... G05F 3/16

[52] U.S. Cl. ..... 323/316; 323/315; 327/538

[58] Field of Search ..... 323/312–316; 307/296.2, 296.6, 296.7

[56] References Cited

U.S. PATENT DOCUMENTS 4,319,179 3/1982 Jett, Jr. .
4,628,248 12/1986 Birrittella et al. ..... 323/314
4,733,161 3/1988 Kuwahara .
4,879,524 11/1989 Bell .
5,049,807 9/1991 Banwell et al. ..... 323/314

FOREIGN PATENT DOCUMENTS 139425 5/1985 European Pat. Off. .
219682 4/1987 European Pat. Off. .

OTHER PUBLICATIONS

I.B.M. Technical Disclosure Bulletin vol.29, No.3, Aug. 1986, New York: USA, pp. 1368–1369; "PNP Current Source Reference Circuit".

*Primary Examiner*—R. Skudy
*Assistant Examiner*—Shawn Riley
*Attorney, Agent, or Firm*—Oblon, Spivak, McClelland, Maier & Neustadt

[57] ABSTRACT

A current source delivering a constant current despite sudden voltage fluctuations which may be applied on its output. This current source includes two branches in parallel, a generating branch and a reference branch. The output current is kept constant by keeping the potential difference across the terminals of the resistors in the generating branch constant, by using a differential amplifier. All the transistors are of the NPN type.

3 Claims, 2 Drawing Sheets

CURRENT SOURCE ADAPTED TO ALLOW FOR RAPID OUTPUT VOLTAGE FLUCTUATIONS

BACKGROUND OF THE INVENTION

The invention concerns a current source which allows rapid voltage fluctuations on its output without affecting the current being delivered. This characteristic of the source is due partly to its structure and partly to the fact that it comprises NPN transistors.

A current source is by definition a circuit which must supply a stable current to another electronic circuit. However, during operation, through changes of state, rapid fluctuations of current can occur in the second circuit, which affect the output of the current source.

If the current source has low impedance, it can supply the current required, but this low impedance produces a reaction which destabilizes the output current. If, on the other hand, the current source has high impedance, it is more stable but can not respond to rapid fluctuations.

The diagram of a current source according to known configurations is shown in FIG. 1. It is very simple and includes a current mirror formed by the transistors Q1 and Q2 and by the current source Q3: this source is regulated using a reference voltage which is produced at the terminals of a resistor $R_{ref}$, and its temperature is controlled by the standard $V_{BG}$ and by the transistor $Q_{ref}$. The transistor Q4 is mounted symmetrically to transistor Q3.

If R3=R4 and if the transistors Q3 and Q4 have the same geometry, they deliver the same currents, and in particular Q3 delivers a current equal to $I_{ref}$. If on the other hand, transistor Q1 has a geometry "n" times greater than that of Q2, it delivers "n" times more current: for example, if n=5, the output current is six times greater than the reference current $I_{ref}$ ($1\times I_{ref}$ across Q2+$5\times I_{ref}$ across Q1).

This architecture has the advantage of being very simple, requiring few transistors and having low consumption. It is an improvement in the sense that the current mirror Q1+Q2, comprising NPN transistors, which amplifies the current, makes it possible to eliminate current gain fluctuations in transistor Q3, which is a PNP transistor.

However, in fast bipolar technology, PNP transistors generally have more gain disperston than NPN transistors.

In addition, the dynamic performances of PNP transistors such as Q3 and Q4 are very inferior to those of NPN transistors such as Q1 and Q2, because the stray capacitances of a PNP transistor are greater than those of an NPN transistor . In these conditions, a rapid fluctuation in the output current $I_S$ (or in the output voltage $V_S$) is not instantly transmitted to the base of the PNP Q3 because of its collector-base stray capacitance, and Q3 does not react quickly enough to correct this fluctuation.

Finally, the modulation of the collector current $I_C$ as a function of the collector-emitter voltage (known as the "Early voltage"), is very low ior a PNP transistor , which makes the output current $I_S$ dependent on the output voltage $V_S$, thus causing static inaccuracy.

SUMMARY OF THE INVENTION

In order to overcome these disadvantages, the invention proposes the following:

production of a current source using exclusively NPN transistors, modification of the architecture of this current source, in particular the replacement of the current mirror by a differential amplifier, which functions to keep the potential difference across the terminals of a resistor constant, thus guaranteeing a constant outgoing current, regardless of the voltage on the output. This means that the current source according to the invention can undergo rapid voltage fluctuations on its output: it does not reflect them and continues to supply a stable output current $I_S$.

To be more precise, the invention concerns a current source adapted to allow rapid voltage fluctuations on its output, including an output current generating branch formed by a first transistor in series with a first resistor, this current source being characterized by the fact that it includes means for keeping the potential difference across the terminals of the first resistor constant.

BRIEF DESCRIPTION OF THE DRAWINGS

The invention will be better understood by reading the following more detailed description, made with reference to the appended figures, wherein.

DESCRIPTION OF THE PREFERRED EMBODIMENT

Figure 2:
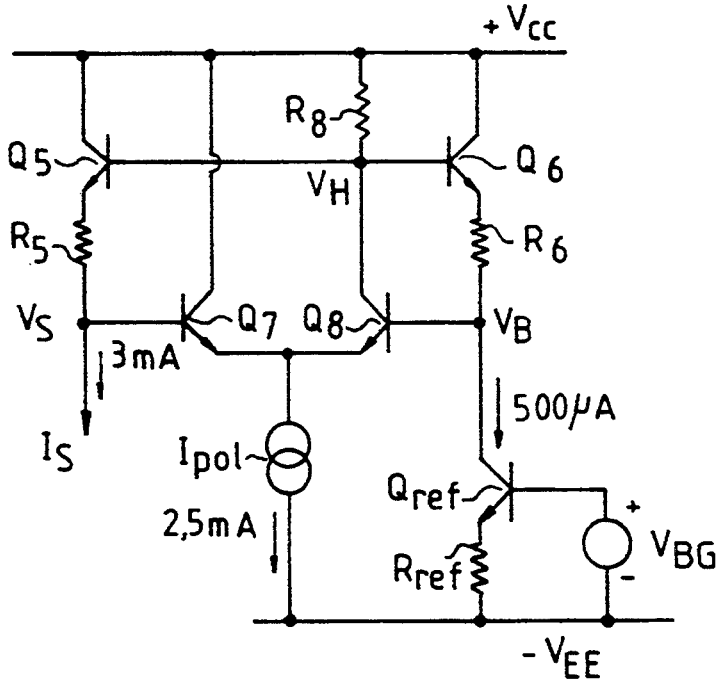
FIG. 2 shows a schematic drawing of a current source according to the invention.

FIG. 2 is the schematic drawing of the current source according to the invention.

Figure 1:
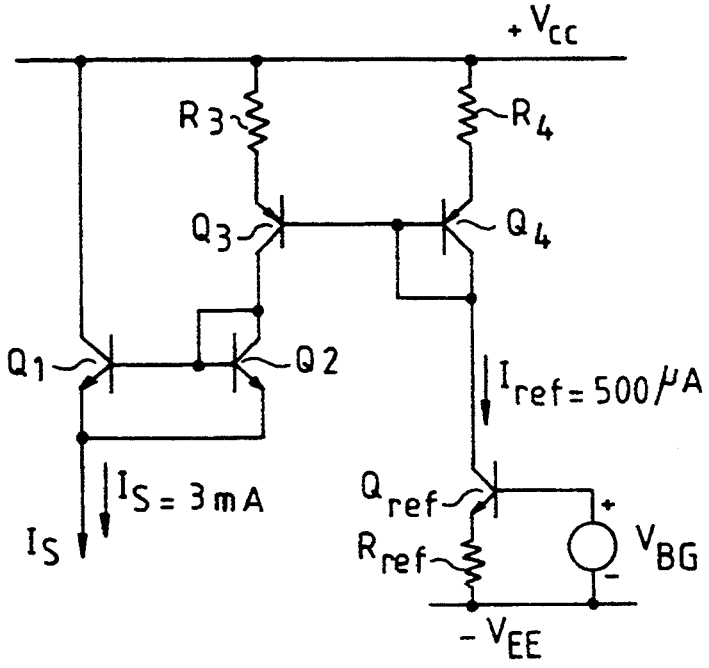
FIG.1 (PRIOR ART)
FIG. 1 shows a schematic drawing of a known current source, as explained previously.

Supplied with current between a positive voltage $+V_{CC}$ and a negative voltage $-V_{EE}$, the branch which supplies a reference current $I_{ref}$ is substantially identical to that in FIG. 1: a transistor $Q_{ref}$ and a resistor $R_{ref}$, whose temperature is regulated by a source of voltage $V_{BG}$, controlling the current through a transistor Q6, in series with a resistor R6 positioned between the emitter of Q6 and the collector of $Q_{ref}$.

The branch constituting the current source, in the strict sense of the term, comprises a transistor Q5, connected to the power supply $+V_{CC}$, in series with a resistor R5, whose free end constitutes the circuit's output terminal. The bases of transistors Q5 and Q6 are linked together and polarized by $V_{CC}$ via a resistor R8.

The basis of the invention is to maintain a constant potential difference across the terminals of the resistor R5, which guarantees a constant outgoing current $I_S$, regardless of the output voltage $V_S$. This is achieved by means of a differential amplifier, formed by transistors Q7 and Q8. The base of transistor Q7 is connected to the low point $V_S$, the free end of the resistor R5 and its collector connected to the supply. The base of transistor Q8 is connected to the low point $V_B$ of the resistor R6, and its collector is connected to point $V_H$ common to the resistor R8 and the bases of transistors Q5 and Q6.

The emitters of the differential amplifier Q7+Q8 are connected to a polarization source, which draws a current $I_{pol}$ towards the power supply $-V_{EE}$.

Disregarding the reference $Q_{ref}+R_{ref}$, the symmetry of the drawing can be seen, as well as the supply of Q7 from $V_{CC}$ and that of Q8 from $V_H$. But the voltage at point $V_H$ corresponds, to within the emitter/base junction of Q5, to the voltage at a first "high" end of R5, and the voltage at point $V_B$ corresponds, through the differential amplifier, to the voltage at a second "low" end of R5, which is also the output voltage $V_S$.

If adapted, this configuration could work with PNP transistors, but in order to achieve the objective, which is that the current $I_S$ remains constant if the voltage $V_S$ fluctuates, it is essential to use exclusively NPN transistors, which have less base stray capacitance.

During operation, the reference current source $Q_{ref}+R_{ref}$ ensures that there is a constant potential difference $V_H—V_B$ across the terminals of the resistor R6 (to within one junction), and that at equilibrium the voltage at point $V_B$ is adjusted to the output voltage at point $V_S$, or the voltage at the "low" point of R5.

However, at the same time, the voltage at the "high" point $V_H$ of R5 (to within one junction) is adjusted to the output voltage $V_S$, across the differential amplifier looped to unit gain. Therefore, if the output voltage $V_S$ fluctuates during operation, the voltage in $V_H$ fluctuates with it. As the difference $V_H—V_B$ is constant, the difference $V_H—V_S$ and therefore the output current $I_S$ will also be constant.

Current amplification is obtained by the geometry of the symmetrical components Q5+R5 and Q6+R6. If the current $I_S$ must be equal to "n" times the current $I_{ref}$, the geometrical dimensions of the transistor Q5 are equal to "n" times those of the transistor Q6, and the value of the resistor R5 is equal to "1/n" times that of the resistor R6. Therefore, purely as an example, in order to deliver 3 mA with a reference current of 500 μA, as in the example in FIG. 1, Q5 must have a geometry equal to 6 times that of Q6, and R5 must equal R6/6.

The exclusive use of NPN transistors, which have less base stray capacitance, provides two types of advantage:

- in dynamic operation, the capacitive effects of the base of Q7 on the output $V_S$ are eliminated. Only a capacitive effect on transistor Qref remains, but this does not disturb the output and it can be reduced by reducing the geometry of $Q_{ref}$;
- in static operation, the fluctuation of $I_S$ in relation to $V_S$ depends on the early effect of the transistor $Q_{ref}$, which is reduced because an NPN transistor has a greater early voltage than a PNP, and also on the offset of the amplifier used.

Figure 3:
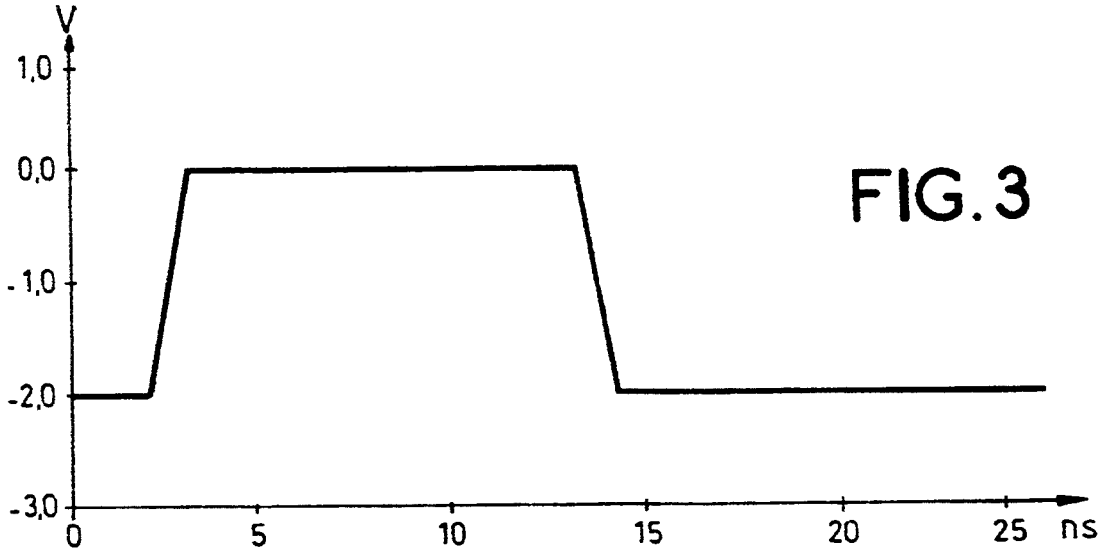
FIGS. 3 to 5 show curves for an applied fluctuation (FIG. 3), comparing the response of the known source (FIG. 4) with the response of source according to the invention (FIG. 5).
Figure 4:
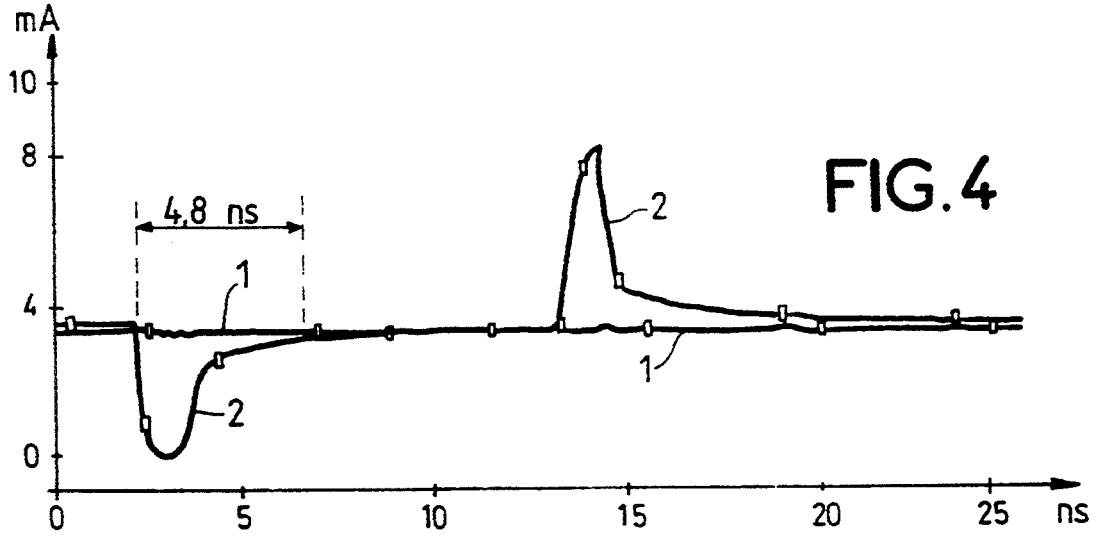
Figure 5:
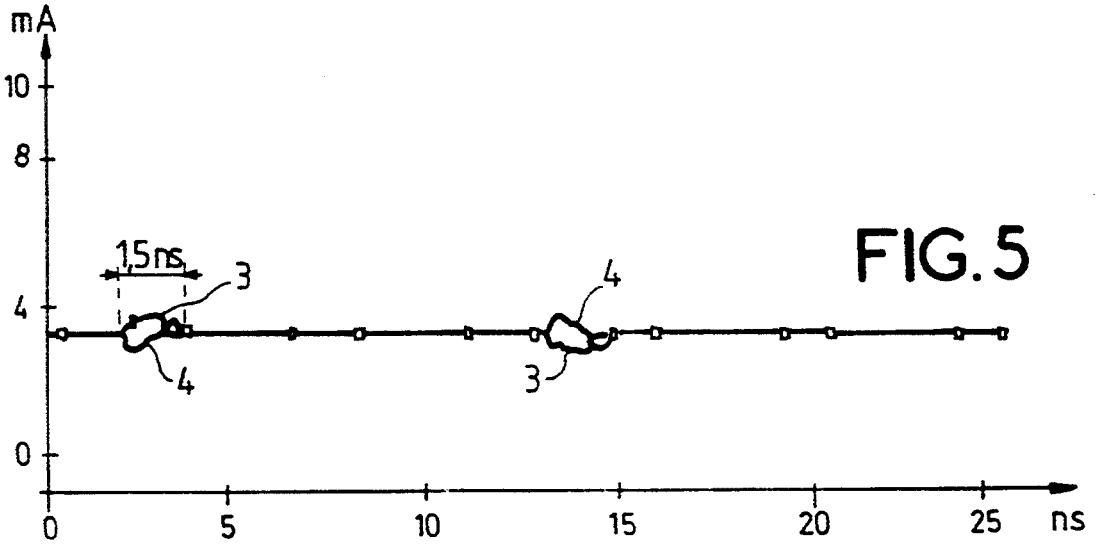

The curves in FIGS. 3 to 5 illustrate the advantage of NPN transistors, and of the circuit according to the invention, in relation to known configurations.

The curve in FIG. 3 shows the form of voltage which is forced on the output $V_S$: it varies by 2 V in 1 ns, that is a fluctuation of 2000 V/μS, better known as "slew-rate". It can be observed how the current source reacts at the rising and falling edges of this fluctuation.

In the case of known configurations, in FIG. 4 the practically straight line 1 shows the reaction of the reference current $I_{ref}$, amplified to adjust it to the level of the output current $I_S$. The current $I_{ref}$ is very constant, but the output current in curve 2 undergoes two rebounds, better known as "overshoot", one on the rising edge and the other on the falling edge. For a pulse at 2000 V/μS, the overshoot reaches 115%, and it takes 4.8 ns for the circuit to return to equilibrium +5%.

Curves 3 and 4 in FIG. 5 correspond to the curves previously described, but represent the current source according to the invention. For an identical pulse of 2 V, with a slew-rate of 2000 V/μS, it can be seen that the reference current (curve 3) undergoes a very slight disturbance, but the output current (curve 4) is disturbed to a much lesser extent than in known configurations. The overshoot is limited to 9% and the disturbance only lasts for 1.5 ns.

This very substantial improvement is due to the exclusive use in the current source according to the invention of NPN type transistors, which have less stray capacitances. A current source can be shaped, in the form of a current generator ($I_d$), in parallel with a resistor ($R_S$) and with a capacitor ($C_d$). For the same generated current $I_d$=3 mA, the current source in FIG. 1 (known configuration) has a resistor $R_S$=10 K ohms and a stray capacity $C_d$=2.3 pF, as long as the current source according to the invention has:

$R_S$=100 K ohms $C_d$=0.15 pF which amounts to dividing the capacity of the source by 15.3 and therefore improving its response time, thus allowing the outgoing current to be independent of fluctuations in the output voltage.

What is claimed is:

1. Current source adapted to allow rapid voltage fluctuations on its output, comprising a generating branch of an output current formed by a first transistor in series with a first resistor, wherein the current source includes means for keeping a potential difference across terminals of said first resistor at a constant value, also including a reference branch formed by a reference voltage source in series with a second resistor and with a second transistor, a base region of the first and second transistors being connected and polarized via a resistor connected to a positive voltage source, said means for keeping the potential difference across the terminals of said first resistor constant comprising third and fourth transistor connected to form a differential amplifier, the third transistor having a collector region thereof connected to the positive voltage source and a base region thereof connected to the output of said current source, a collector region of the fourth transistor is connected to base regions of the first and second transistors and a base region of said fourth transistor is connected between the second resistor and said reference voltage source.

2. Current source according to claim 1, wherein the first through fourth transistors are of all the NPN type.

3. Current source according to claim 2, wherein the output voltage fluctuations are copied by the differential amplifier at a point of the reference branch between the second resistor and said reference voltage source and also at a point of connection of the base regions of Said first and second transistors, maintaining a constant potential difference across the terminals of the first resistor.

* * * * *